United States Patent [19]

Cruz et al.

[11] Patent Number: 4,858,888

[45] Date of Patent: Aug. 22, 1989

[54] PLATFORM LIFTING MECHANISM

[76] Inventors: Onelio Cruz; Neal Cruz, both of 3294 NW. 69th St., Miami, Fla. 33147

[21] Appl. No.: 217,693

[22] Filed: Jul. 11, 1988

[51] Int. Cl.[4] ..... B66F 3/22

[52] U.S. Cl. ..... 254/122

[58] Field of Search ..... 52/109; 254/122, 126, 254/9 C; 187/18; 182/141, 63, 69

[56] References Cited

U.S. PATENT DOCUMENTS

| | | | |
|---|---|---|---|
| 2,501,001 | 3/1950 | Neely | 254/122 |
| 2,862,689 | 12/1958 | Dalrymple et al. | 254/122 |
| 3,891,108 | 6/1975 | Traficant . | |

FOREIGN PATENT DOCUMENTS

| | | | |
|---|---|---|---|
| 995655 | 1/1974 | Canada | 254/122 |
| 3436782 | 12/1986 | Fed. Rep. of Germany | 254/122 |
| 102666 | 10/1963 | Norway | 254/122 |

*Primary Examiner*—Robert C. Watson

*Attorney, Agent, or Firm*—Jesus Sanchelima

[57] ABSTRACT

A mechanism to be used on vehicles' chassis for lifting loads and including scissor-action means that are distensible by applying hydraulic force to its structural members. The mechanism includes a safety linkage assembly for connecting the piston rod of the hydraulic cylinder to the structural members that are pivotally mounted to the chassis. The linkage mechanism prevents slipping of the rod under drastic load changes.

3 Claims, 3 Drawing Sheets

PLATFORM LIFTING MECHANISM

BACKGROUND OF THE INVENTION

1. Field of the Invention

The present invention relates to platform lifting mechanisms, and more particularly, to an improved mechanism for efficiently utilizing the hydraulic force while maintaining its safety.

2. Description of the Related Art

A number of mechanisms have been designed in the past that incorporate a scissor-type assembly equipped with hydraulic cylinders for distending its members. Ideally, in its lowermost position, the cylinders will be as flat as possible, parallel to the plane of the chassis where these mechanisms are usually mounted. An in distension, the criss-crossed structural members extend towards a vertical position to fully utilize the capabilities of the hydraulic cylinders. These lifting mechanisms usually carry variable loads and their hydraulic cylinders can snap out of their positions. This has caused fatalities in the industry.

Applicant believes that the closest reference corresponds to U.S. Pat. No. 3,891,108 issued to Charles Traficant. However, it differs from the present invention because it lacks the safety features claimed below that prevents the hydraulic cylinders from snapping out when load conditions changes. Traficant discloses abutment 82 to limit the travel of piston rod 55 and roller assembly 56; 58; 60 and 62 in one direction but there is nothing to prevent it from slipping out in the other direction. When load conditions are reduced drastically, the hydraulic means continue to push upwardly and cause piston rod to continue its angularly upward travel.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a lifting mechanism that is safe and reliable without adversely affecting its efficiency.

It is another object of this present invention to provide a simple lifting mechanism that is easy to maintain and that utilizes a minimum of moving parts.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
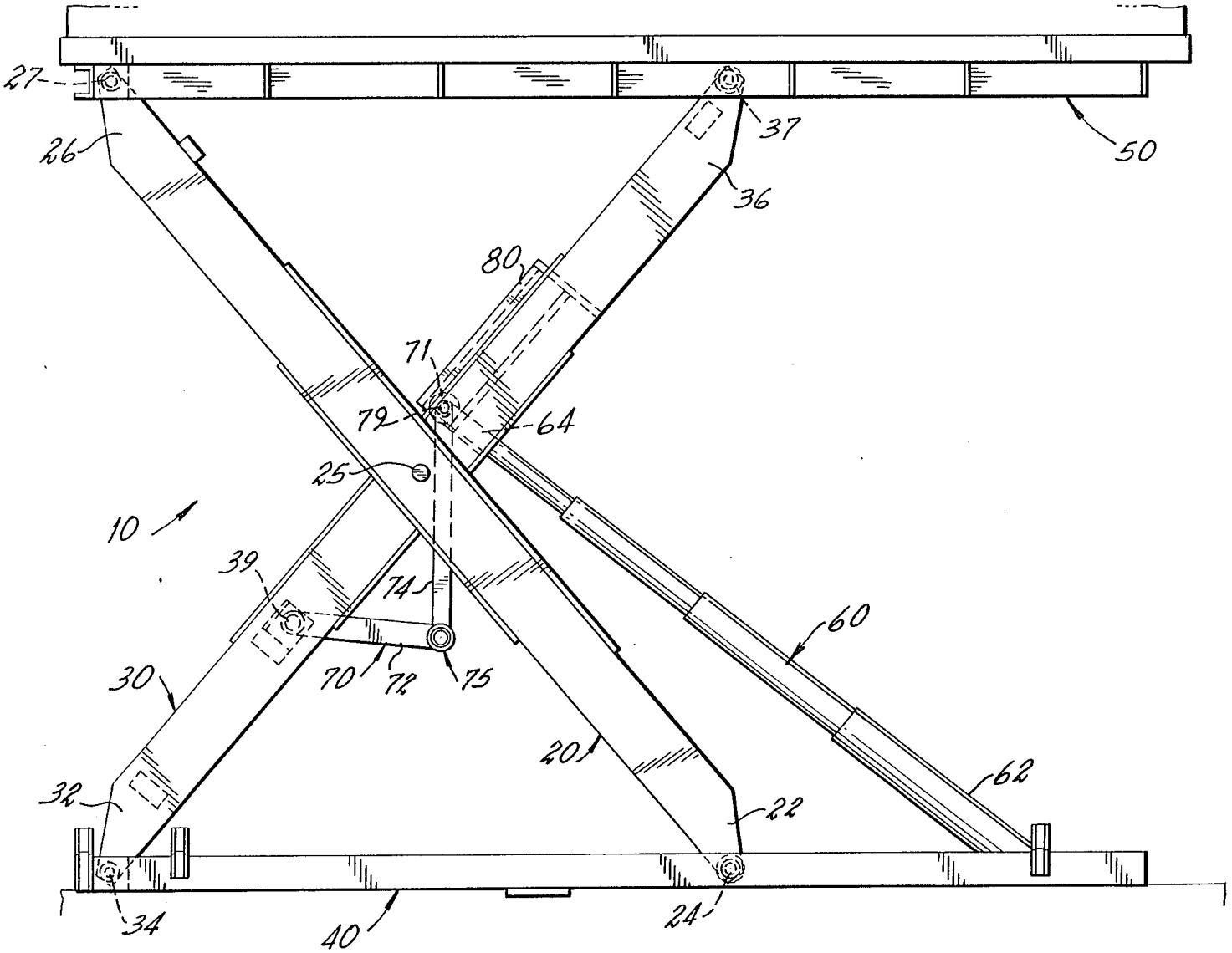
FIG. 1 represents a side elevational view of the lifting mechanism.

Referring now to FIG. 1, where the present invention is generally referred to with numeral 10, it can be observed that it basically includes criss-crossed elongated structural members 20 and 30 that are pivotally mounted to each other at their centers through pin member 25. Members 20 and 30 have lower ends 22 and 32. End 32 is pivotally mounted to chassis member 40 through pin member 34. End 22 includes roller member 24 that travels within chassis structure 40. Upper end 26 of member 20 is pivotally mounted to platform assembly 50 through pin member 27. Upper end 36 includes roller member 37 that travels along a horizontal path within platform member 50. Hydraulic cylinder assembly 60 is pivotally mounted at one end 62 to chassis member 40. Distensible piston rod 64 is pivotally mounted to axle 79 of linkage assembly 70.

Figure 2:
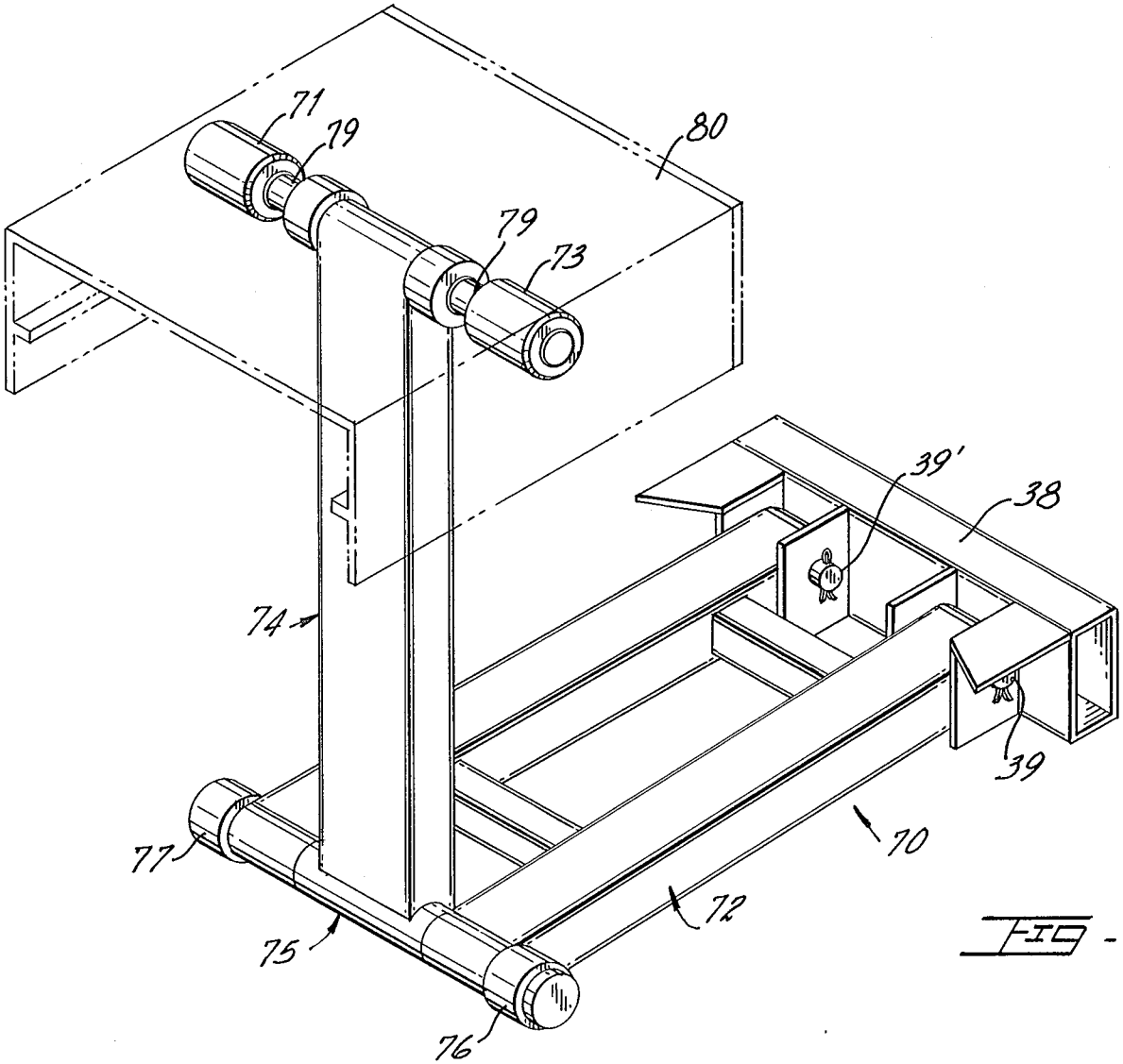
FIG. 2 shows an enlarged view of the linkage assembly.
Figure 4:
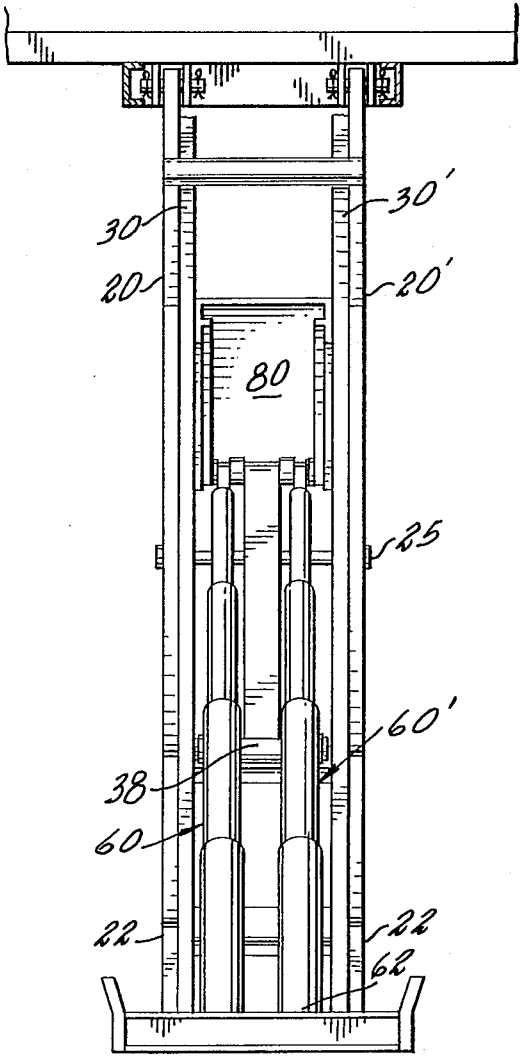
FIG. 4 is a representation of the front view of the mechanism shown in FIG. 1.
Figure 3:
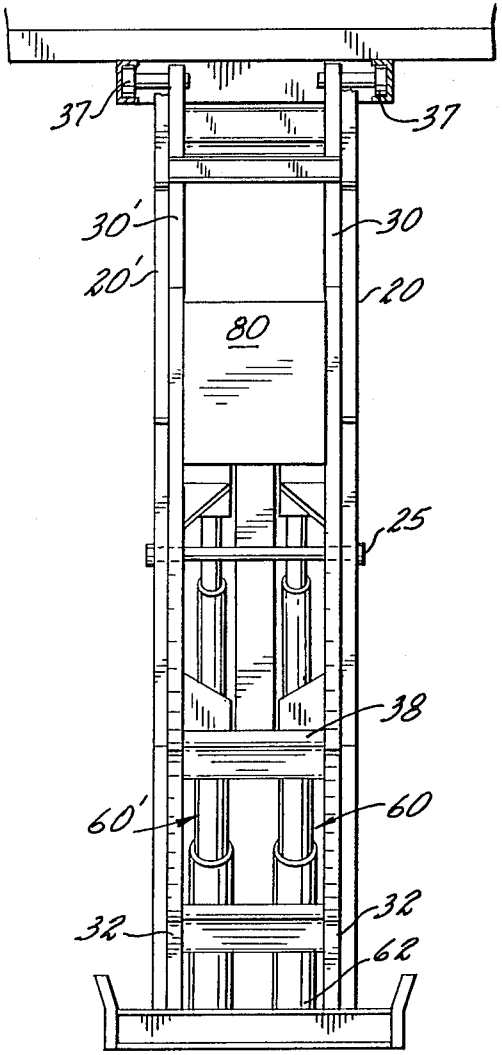
FIG. 3 illustrates a rear elevational view of the mechanism shown in FIG. 1.

As best seen in FIG. 2, linkage assembly 70 comprises two hingedly mounted arm members 72 and 74 that form elbow assembly 75. Elbow assembly 75 includes roller members 76 and 77 at its sides. The end of arm member 72 away from elbow assembly 75 is pivotally mounted to anchorage member 38 through pin member 39 and 39' at a point on member 30 below pin 25. The end of arm member 74 not connected to arm member 72 is terminated with a perpendicularly disposed axle 79 that includes roller members 71 and 73 at its sides. Roller members 71 and 73 come in contact with channel member 80 which is rigidly mounted between parallel running members 30 and 30' in the preferred embodiment.

In operation, hydraulic cylinder assemblies 60 and 60' start their distension until they reach the position shown in FIG. 1. Rollers 71 and 73 have transmitted the force imparted by cylinders 60 and 60' to the bottom surface of bearing plate member 80 which in turn causes member 30 to move in a counter-clockwise direction.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A lifting mechanism, comprising:

A. a chassis member;

B. scissor-action means including two pairs of elongated structural members in pivotal criss-cross arrangement with respect to each other, each elongated structure member having upper and lower ends, wherein said upper ends of said first two elongated structural members include third roller means for supporting said platform member and first two of said elongated structural members in opposite location being pivotally mounted to said chassis member at their lower ends and the second two elongated structural members including first roller means at their lowest ends for travelling within said chassis member;

C. platform means pivotally supported by said second two elongated structural members and slidably supported by the upper ends of said first two elongated structural members;

D. hydraulic means for lifting said platform including at least one distensible piston rod having second roller means at its end and one cylinder that is pivotally mounted to said chassis;

E. linkage means for pivotally securing said piston rod to said first two elongated members and said linkage means including first and second hingedly connected arm members at one of the ends and the other ends of said arm members being pivotally mounted to said first two elongated structural members and the second arm member being pivotally mounted to said first roller means;

F. a bearing plate member rigidly mounted to and between said first two elongated structural members and said bearing plate member positioned for cooperatively receiving said second roller means.

2. The mechanism set forth in claim 1 wherein said linkage means includes an axle that is perpendicularly mounted to the other end of said arm member mounted to said first roller means.

3. The mechanism set forth in claim 2 wherein said linkage means includes an anchorage member perpendicularly mounted to said first two elongated structural members and to said first arm member.

* * * * *